US007280969B2

(12) United States Patent
Eide et al.

(10) Patent No.: US 7,280,969 B2
(45) Date of Patent: Oct. 9, 2007

(54) METHOD AND APPARATUS FOR PRODUCING NATURAL SOUNDING PITCH CONTOURS IN A SPEECH SYNTHESIZER

(75) Inventors: Ellen Marie Eide, Mount Kisco, NY (US); Raimo Bakis, Briarcliff Manor, NY (US)

(73) Assignee: International Business Machines Corporation, Armonk, NY (US)

( * ) Notice: Subject to any disclaimer, the term of this patent is extended or adjusted under 35 U.S.C. 154(b) by 954 days.

(21) Appl. No.: 09/732,122

(22) Filed: Dec. 7, 2000

(65) Prior Publication Data

US 2002/0072909 A1 Jun. 13, 2002

(51) Int. Cl.
*G10L 13/06* (2006.01)

(52) U.S. Cl. ..... 704/268

(58) Field of Classification Search ..... 704/258–269
See application file for complete search history.

(56) References Cited

U.S. PATENT DOCUMENTS 4,278,838 A * 7/1981 Antonov ..... 704/260
4,586,193 A * 4/1986 Seiler et al. ..... 704/261
4,692,941 A * 9/1987 Jacks et al. ..... 704/260
4,797,930 A * 1/1989 Goudie ..... 704/268
5,327,498 A * 7/1994 Hamon ..... 704/268
5,400,434 A * 3/1995 Pearson ..... 704/264
5,490,234 A * 2/1996 Narayan ..... 704/260
5,517,595 A * 5/1996 Kleijn ..... 704/205
5,797,120 A * 8/1998 Ireton ..... 704/226
6,208,969 B1 * 3/2001 Curtin ..... 704/264
6,253,182 B1 * 6/2001 Acero ..... 704/268
6,418,408 B1 * 7/2002 Udaya Bhaskar et al. .. 704/219
6,499,014 B1 * 12/2002 Chihara ..... 704/260
6,697,457 B2 * 2/2004 Petrushin ..... 379/88.08

OTHER PUBLICATIONS

Tohkura et al.; Spectral Smoothing Technique in PARCOR Speech Analysis-Synthesis; 1978 IEEE; pp. 587-596.*
S.R. Hertz, "The Technology of Text-to-Speech," Speech Technology (Apr. 18-20/May 1997).
S.R. Hertz, "Space, Speed, Quality, and Flexibility: Advantages of Rule-Based Speech Synthesis", Conference Proceedings, AVIOS 2000, May 22-24, 2000, San Jose, CA.

* cited by examiner

*Primary Examiner*—Abul K. Azad
(74) *Attorney, Agent, or Firm*—Ryan, Mason & Lewis, LLP

(57) ABSTRACT

A speech synthesis system is disclosed that utilizes a pitch contour resulting in a more natural-sounding speech. The present invention modifies the predicted pitch, b(t), for synthesized speech using a low frequency energy booster. The low frequency energy booster interpolates the discrete pitch values, if necessary, and increase the amount of energy of the pitch contour associated with low frequency values, such as all frequency values below 10 Hertz. The amount of energy of the pitch contour associated with low frequency values can be increased, for example, by adding band-limited noise (a carrier signal) to the pitch contour, b(t), or by filtering the pitch values with an impulse response filter having a pole at the desired low frequency value. The present invention serves to add vibrato to the to the original pitch contour, b(t), and thereby improves the naturalness of the synthetic waveform.

24 Claims, 4 Drawing Sheets

METHOD AND APPARATUS FOR PRODUCING NATURAL SOUNDING PITCH CONTOURS IN A SPEECH SYNTHESIZER

FIELD OF THE INVENTION

The present invention relates generally to speech synthesis systems and, more particularly, to methods and apparatus that generate natural sounding speech.

BACKGROUND OF THE INVENTION

Speech synthesis techniques generate speech-like waveforms from textual words or symbols. Speech synthesis systems have been used for various applications, including speech-to-speech translation applications, where a spoken phrase is translated from a source language into one or more target languages. In a speech-to-speech translation application, a speech recognition system translates the acoustic signal into a computer-readable format, and the speech synthesis system reproduces the spoken phrase in the desired language.

FIG. 1 is a schematic block diagram illustrating a typical conventional speech synthesis system 100. As shown in FIG. 1, the speech synthesis system 100 includes a text analyzer 110 and a speech generator 120. The text analyzer 110 analyzes input text and generates a symbolic representation 115 containing linguistic information required by the speech generator 120, such as phonemes, word pronunciations, phrase boundaries, relative word emphasis, and pitch patterns. The speech generator 120 produces the speech waveform 130. For a general discussion of speech synthesis principles, see, for example, S. R. Hertz, "The Technology of Text-to-Speech," Speech Technology, 18-21 (April/May, 1997), incorporated by reference herein.

In a concatenative speech synthesis system, stored segments of human speech are typically pieced together to produce the speech output. When an utterance is synthesized by the speech generator 120, the corresponding speech segments are retrieved, concatenated, and modified to reflect prosodic properties of the utterance, such as intonation and duration. Each of the concatenated speech segments has an inherent natural pitch contour that was uttered by the speaker. However, when small portions of natural speech arising from different utterances in the segment database are concatenated, the resulting synthetic speech does not have a natural sounding pitch contour.

To produce natural-sounding speech, the speech generator 120 must produce acoustic values, durations, and pitch patterns that simulate properties of human speech. The acoustic values and durations of a speech segment depend on the neighboring segments, degree of syllable stress and position in the syllable. Pitch patterns are a function of linguistic properties of the utterance as a whole. Prediction of the pitch patterns is an important aspect of generating natural-sounding speech.

Typically, the pitch contour of the concatenated segments are modified using a predefined pitch contour, using either a statistical or rule-based method, that is imposed on the synthetic speech using digital signal processing techniques. The desired contour is typically specified as one or more values per vowel or syllable. Thereafter, the pitch contour values associated with each syllable are connected, for example, using a piece wise linear function, resulting in a continuous function of pitch versus time throughout the synthetic utterance.

While speech synthesis systems employing such pitch contour techniques perform effectively for a number of applications, they suffers from a number of limitations, which if overcome, could greatly expand the performance and utility of such speech synthesis systems. Specifically, currently available speech synthesis systems 100 fail to produce speech that approaches a natural-sounding human. A need therefore exists for a speech synthesis system that utilizes a pitch contour resulting in a more natural-sounding speech.

SUMMARY OF THE INVENTION

Generally, the present invention provides a speech synthesis system that utilizes a pitch contour resulting in a more natural-sounding speech. The present invention modifies the predicted pitch, b(t), for synthesized speech using a low frequency energy booster. The low frequency energy booster interpolates the discrete pitch values, if necessary, and increase the amount of energy of the pitch contour associated with low frequency values, such as all frequency values below 10 Hertz. The amount of energy of the pitch contour associated with low frequency values can be increased, for example, by adding band-limited noise (a carrier signal) to the pitch contour, b(t), or by filtering the pitch values with an impulse response filter having a pole at the desired low frequency value. The present invention serves to add vibrato to the original pitch contour, b(t), and improves the naturalness of the synthetic waveform.

A more complete understanding of the present invention, as well as further features and advantages of the present invention, will be obtained by reference to the following detailed description and drawings.

DETAILED DESCRIPTION OF PREFERRED EMBODIMENTS

Figure 1:
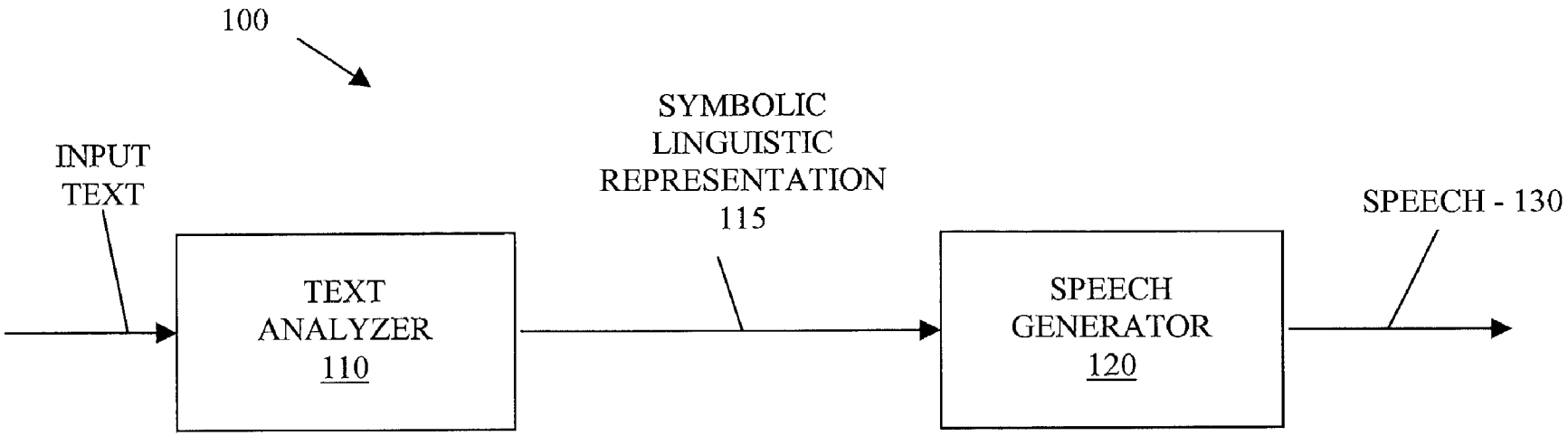
PRIOR ART FIG. 1
FIG. 1 is a schematic block diagram of a conventional speech synthesis system.
Figure 2:
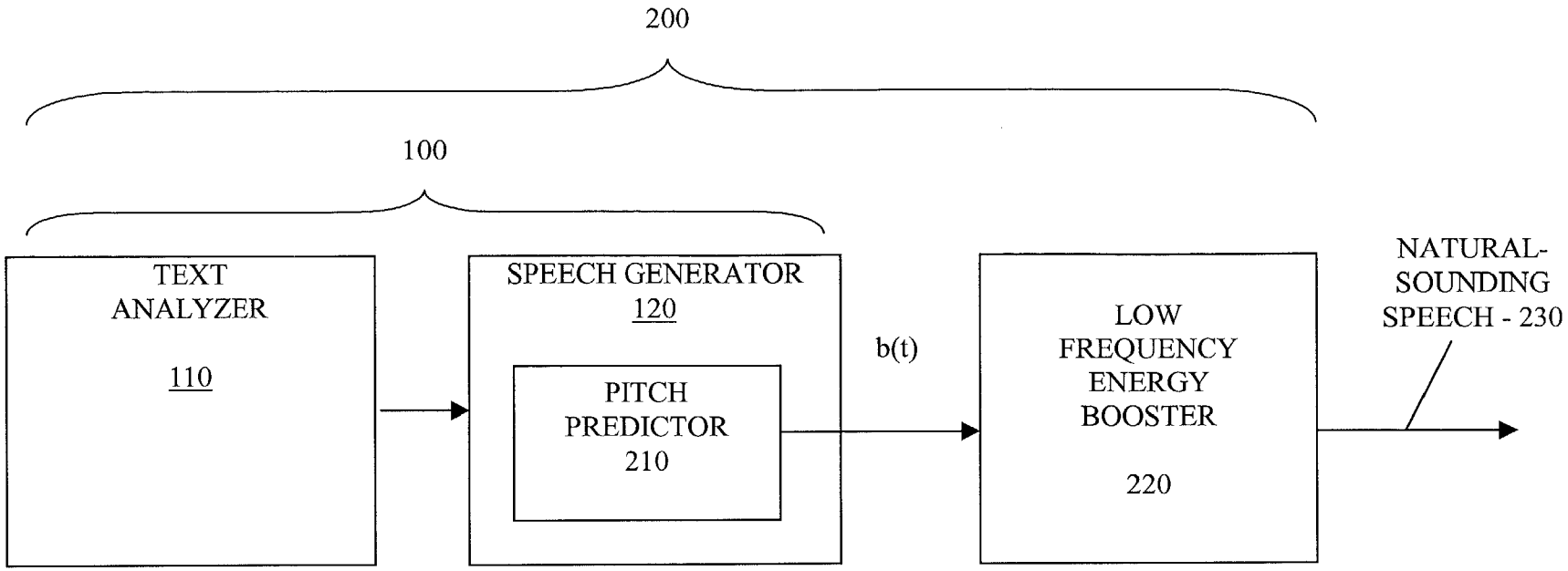
FIG. 2 is a schematic block diagram of a speech synthesis system in accordance with the present invention.

FIG. 2 is a schematic block diagram illustrating a speech synthesis system 200 in accordance with the present invention. The present invention is directed to a method and apparatus for synthesizing speech that utilizes an improved pitch contour resulting in a more natural-sounding speech.

As shown in FIG. 2, the speech synthesis system 200 includes the conventional speech synthesis system 100, discussed above, as well as a low frequency energy booster 220. The conventional speech synthesis system 100 may be embodied as the ETI-Eloquence 5.0, commercially available from Eloquent Technology, Inc. of Ithaca, N.Y., as modified herein to provide the features and functions of the present invention. As shown in FIG. 2, the conventional speech synthesis system 100 includes a pitch predictor 210 that predicts the pitch, b(t), of the utterance associated with the input text, in a known manner. As previously indicated, the predicted pitch, b(t), provides a pitch value specified for each syllable.

Figure 3:
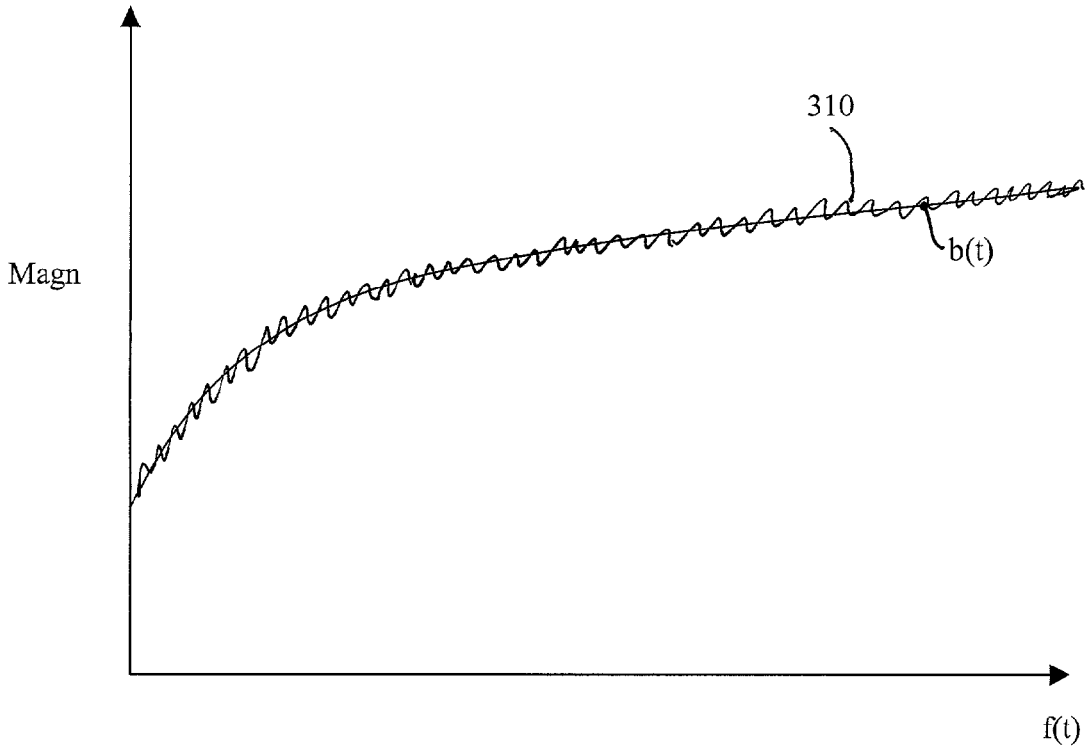
FIG. 3 is a frequency spectrum illustrating a certain amount of bravado that is added to the original pitch contour, b(t), in accordance with the present invention.

According to a feature of the present invention, the predicted pitch, b(t), is modified by the low frequency energy booster 220 to interpolate the discrete pitch values and increase the amount of energy of the pitch contour associated with low frequency values, such as below 10 Hertz. The amount of energy of the pitch contour associated with low frequency values can be increased, for example, by adding band-limited noise (a carrier signal) to the pitch contour, b(t). In this manner, the use of the carrier signal contributes vibrato 310 to the original pitch contour, b(t), as shown in FIG. 3, and improves the naturalness of the synthetic waveform.

Thus, in one implementation, the vibrato 310 corresponds to a periodic carrier waveform, p(t), added to the pitch contour, b(t). Thus, the pitch frequency, f(t), of the speech 230 generated by the speech synthesis system 200 can be expressed as follows:

$$f(t)=b(t)+p(t),$$

where $p(t)=a\sin(\overline{\omega}t+\Phi)$;

a=amplitude of the pitch variation;

$\overline{\omega}=2\pi f_r$; and $f_r$=rate of pitch variation

Thus, the pitch frequency, f(t), corresponds to a narrow band, low frequency noise signal. In one illustrative embodiment, the narrow band results in a single low frequency sine wave; having a frequency, $f_r$, of 2.7 Hertz (Hz) and an amplitude, a, of 10 Hz. Thus, the original pitch contour, b(t), is varied by +/−10 Hz at a rate of 2.7 Hz. It is noted that these parameters may vary depending on the sex, dialect and other speech parameters of the speaker associated with the synthesized speech. The pitch frequency, f(t), of the speech 230 generated by the speech synthesis system 200 can be also expressed as the sum of its sinusoidal components.

Figure 4:
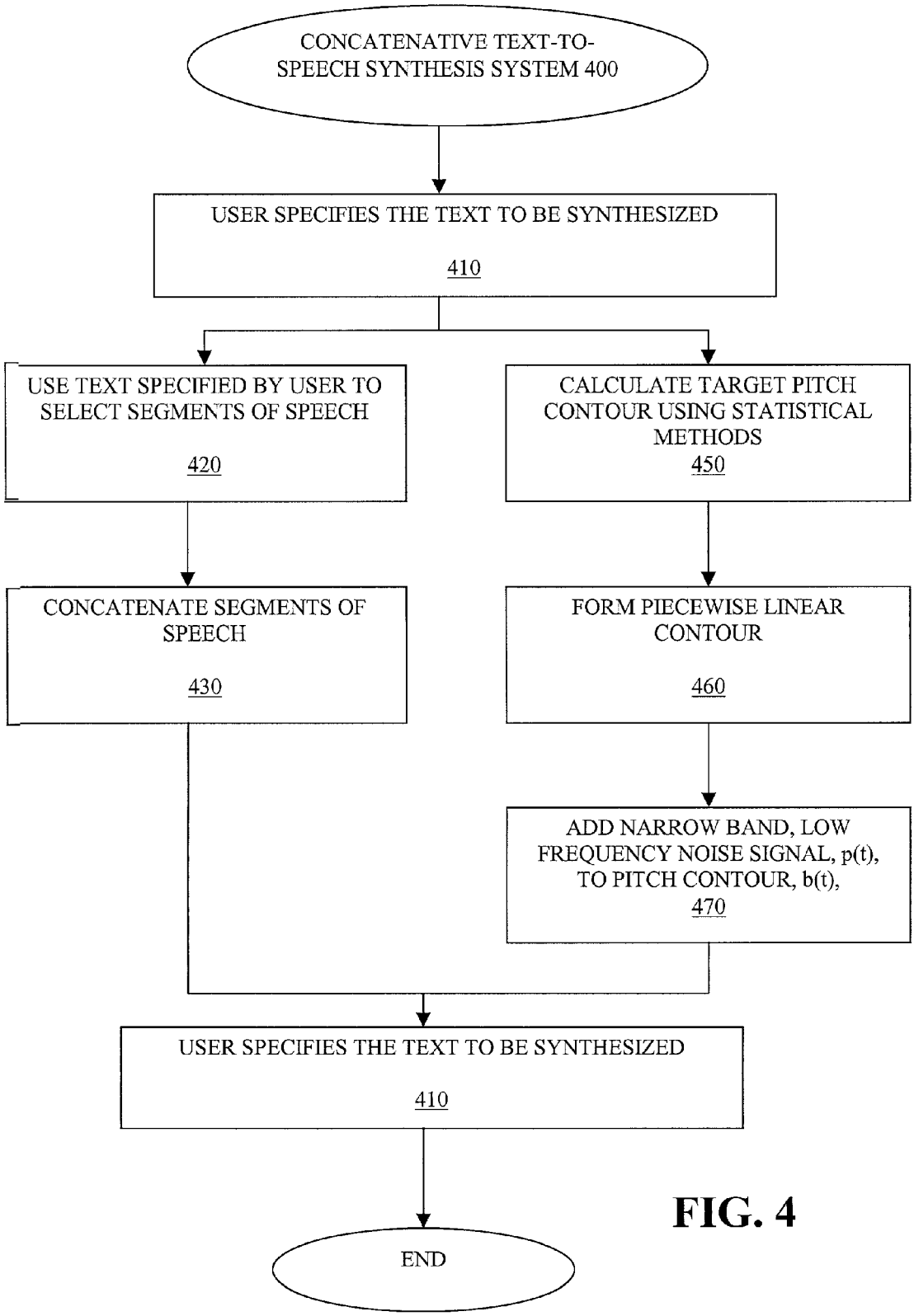
FIG. 4 is a flow chart describing an exemplary concatenative text-to-speech synthesis system incorporating features of the present invention.

FIG. 4 is a flow chart describing an exemplary implementation of a concatenative text-to-speech synthesis system 400 incorporating features of the present invention. As shown in FIG. 4, the user initially specifies the text he or she wishes to be synthesized during step 410. The text specified by the user is then used during step 420 to select the segments of speech that will be concatenated during step 430 to form the synthetic waveform.

The user-specified text is also used during step 450 to calculate the desired pitch value for each syllable in the utterance using statistical methods. From the desired pitch values a piece wise linear contour is formed during step 460, yielding the pitch contour, b(t), a function of pitch versus time. Each of the steps performed in obtaining the pitch contour, b(t), may be performed in a conventional manner, such as using the techniques employed by the ETI-Eloquence 5.0, referenced above.

During step 470, a narrow band, low frequency noise signal, p(t), is added to the pitch contour, b(t), obtained in the previous step, in accordance with the present invention. The output of the summation of step 470 becomes the final pitch contour of the synthesized waveform. Thereafter, the pitch of the concatenated segments is adjusted during step 480 to exhibit the final contour. After the pitch has been adjusted, the synthetic speech is available to be sent to a file or speaker.

The present invention can manipulate the pitch contour, b(t), in various ways to increase the amount of energy with low frequency components, such as below 10 Hz, as would be apparent to a person of ordinary skill in the art. In a further variation, the discrete pitch values associated with each syllable can be interpolated in accordance with a procedure that likewise increases the amount of energy with low frequency components. For example, the present invention can be accomplished by passing the pitch values through an appropriate filter to increase the low frequency energy, such as an impulse response filter having a pole at the desired $f_r$.

It is to be understood that the embodiments and variations shown and described herein are merely illustrative of the principles of this invention and that various modifications may be implemented by those skilled in the art without departing from the scope and spirit of the invention.

For example, we have mentioned the use of this invention in a concatenative speech synthesis system. However, any method of producing synthetic speech, for example, formant synthesis or phrase splicing, could also make use of the invention by including a method for predicting pitch at the syllable level and imbedding that contour in a narrow band, low frequency noise signal, as would be apparent to a person of ordinary skill in the art.

What is claimed is:

1. A method for synthesizing speech, comprising:

generating a pitch contour for said synthesized speech; and enhancing the natural sound of concatenated synthesized speech segments by increasing an amount of energy in low frequency components of said pitch contour.

2. The method of claim 1, wherein said low frequency components are below approximately 10 Hz.

3. The method of claim 1, further comprising the step of interpolating discrete pitch values to generate said pitch contour.

4. The method of claim 1, wherein said increasing step further comprises the step of adding band limited noise to said pitch contour.

5. The method of claim 4, wherein said band limited noise is comprised of one or more sinusoidal components.

6. The method of claim 4, wherein said band limited noise may be expressed as $a \times \sin(\overline{\omega}t+\Phi)$, where a is the amplitude of the pitch variation, $\overline{\omega}=2\pi f_r$; and $f_r$ is the rate of pitch variation.

7. The method of claim 1, wherein said increasing step further comprises the step of filtering said pitch contour with an impulse response filter having a pole at a desired low frequency value.

8. The method of claim 1, wherein said increasing step serves to add vibrato to said pitch contour.

9. The method of claim 1, wherein said pitch contour comprises a pitch value associated with each syllable of said speech.

10. A method for synthesizing speech, comprising:

generating a pitch contour for said synthesized speech; and enhancing the natural sound of concatenated synthesized speech segments by adding band limited noise to said pitch contour.

11. The method of claim 10, wherein said band limited noise is added only to low frequency components below approximately 10 Hz.

12. The method of claim 10, further comprising the step of interpolating discrete pitch values to generate said pitch contour.

13. The method of claim 10, wherein said band limited noise is comprised of one or more sinusoidal components.

14. The method of claim 10, wherein said band limited noise may be expressed as $a \times \sin(\overline{\omega}t+\Phi)$, where a is the amplitude of the pitch variation, $\overline{\omega}=2\pi f_r$; and $f_r$ is the rate of pitch variation.

15. The method of claim 10, wherein said adding step serves to add vibrato to said pitch contour.

16. The method of claim 10, wherein said pitch contour comprises a pitch value associated with each syllable of said speech.

17. A method for synthesizing speech, comprising:

generating a pitch contour for said synthesized speech; and enhancing the natural sound of concatenated synthesized speech segments by filtering said pitch contour with an impulse response filter having a pole at a desired low frequency value.

18. The method of claim 17, wherein low frequency value is below approximately 10 Hz.

19. The method of claim 17, further comprising the step of interpolating discrete pitch values to generate said pitch contour.

20. The method of claim 17, wherein said increasing step serves to add vibrato to said pitch contour.

21. The method of claim 17, wherein said pitch contour comprises a pitch value associated with each syllable of said speech.

22. A speech synthesizer, comprising:

a pitch predictor that generates a pitch contour for said synthesized speech; and a low frequency energy booster to enhance the natural sound of concatenated synthesized speech segments by increasing an amount of energy in low frequency components of said pitch contour.

23. The speech synthesizer of claim 22, wherein said low frequency energy booster adds band limited noise to said pitch contour.

24. The speech synthesizer of claim 22, wherein said low frequency energy booster filters said pitch contour with an impulse response filter having a pole at a desired low frequency value.

* * * * *